US005931365A

United States Patent [19]

Huang

[11] Patent Number: 5,931,365

[45] Date of Patent: Aug. 3, 1999

[54] STAPLER HAVING TWO MAGAZINES USING STAPLES WITH DIFFERENT SIZES

[76] Inventor: Bao Ruh Huang, No. 136, Tsu Chiang Road, Chang Hua City, Taiwan

[21] Appl. No.: 09/118,921

[22] Filed: Jul. 20, 1998

[51] Int. Cl.[6] ..... B25C 5/16

[52] U.S. Cl. ..... 227/109; 227/120; 227/139

[58] Field of Search ..... 227/109, 135, 227/138, 134, 139, 120

[56] References Cited

U.S. PATENT DOCUMENTS

| | | | |
|---|---|---|---|
| 2,716,749 | 9/1955 | Timmerbeil | 227/109 |
| 3,958,738 | 5/1976 | Tremblay | 227/109 |
| 4,405,073 | 9/1983 | Salleras Escalante | 227/120 |
| 4,496,091 | 1/1985 | Yasuda | 227/120 |
| 4,552,296 | 11/1985 | Sheng | 227/109 |
| 4,556,161 | 12/1985 | Oide | 227/109 |
| 5,038,992 | 8/1991 | Shiang et al. | 227/120 |
| 5,794,832 | 8/1998 | Chen | 227/109 |

FOREIGN PATENT DOCUMENTS

| | | | |
|---|---|---|---|
| 2165793 | 4/1986 | United Kingdom | 227/109 |

*Primary Examiner*—Scott A. Smith
*Assistant Examiner*—James P Calve
*Attorney, Agent, or Firm*—Bacon & Thomas, PLLC

[57] ABSTRACT

A stapler includes a base with an operation arm pivotally connected to a frame extending from the base. A first magazine and a second magazine which is received in the first magazine are pivotally connected to the frame so that the staples with small size can be received in the second magazine and the staples with large size can be mounted between the two magazines. A staple follower includes an inner portion to push the staples with small size and an outer portion to push the staples with large size. The stapler employs either one of two staples having different sizes.

6 Claims, 5 Drawing Sheets

STAPLER HAVING TWO MAGAZINES USING STAPLES WITH DIFFERENT SIZES

FIELD OF THE INVENTION

The present invention relates to a stapler, and more particularly, to an improved stapler having two magazines with different sizes so as to eject staples with two sizes.

BACKGROUND OF THE INVENTION

A conventional stapler includes a base with an operation arm pivotally connected to one of two ends of the base, a magazine is pivotally mounted to an underside of the operation arm so as to receive staples therein. The operation arm has an ejecting plate extending from the front end of the underside thereof and the magazine has a slit defined therethrough so that the ejecting plate is able to extend through the slit to eject a staple out from the magazine. However, the conventional stapler can only use a single size of the staples so that when stapling a thick file, the user has to find another stapler which employs staples with a large size. Therefore, the conventional staples cannot meet the requirements of practical usage and are deemed to take too much time when changing or looking for another stapler.

The present invention intends to provide a stapler having two magazines so as to employ either one of two types of staples. The stapler of the present invention is designed to mitigate and/or obviate the disadvantage of the conventional stapler.

SUMMARY OF THE INVENTION

In accordance with one aspect of the present invention, there is provided a stapler comprising a base having a frame extending from a first end thereof and an anvil mounted to a second end thereof, an operation arm having a first end thereof pivotally connected to the frame and an ejecting plate extending from a second end thereof. A first magazine has a first end thereof pivotally connected to the frame and a second end thereof having a slit defined in a first bottom thereof. Two first side walls respectively extend from two sides of the first bottom from which a first lug and a second lug respectively extend. A second magazine is received in the first magazine and has a second bottom with two second side walls extending from two sides of the second bottom. A cutout is defined in the second bottom and located in alignment with the slit. A third lug and a fourth lug respectively extend.

A staple follower has an inner portion slidably received between the two second side walls and an outer portion slidably received between the first side walls and the second side walls. A fifth lug extends from the inner portion. A flexible plate has a first end thereof fixedly connected to the operation arm and a second end thereof connected to the staple follower. A rod extends through the first lug, the third lug, the fifth lug, the second lug and the fourth lug. A first spring is mounted to the rod and biased between the first lug and the third lug. A second spring is mounted to the rod and biased between the third lug and the fifth lug.

The object of the present invention is to provide a stapler which uses either one of two types of staples with different sizes.

Further objects, advantages, and features of the present invention will become apparent from the following detailed description with appropriate reference to the accompanying drawings.

DETAILED DESCRIPTION OF THE PREFERRED EMBODIMENT

Figure 1:
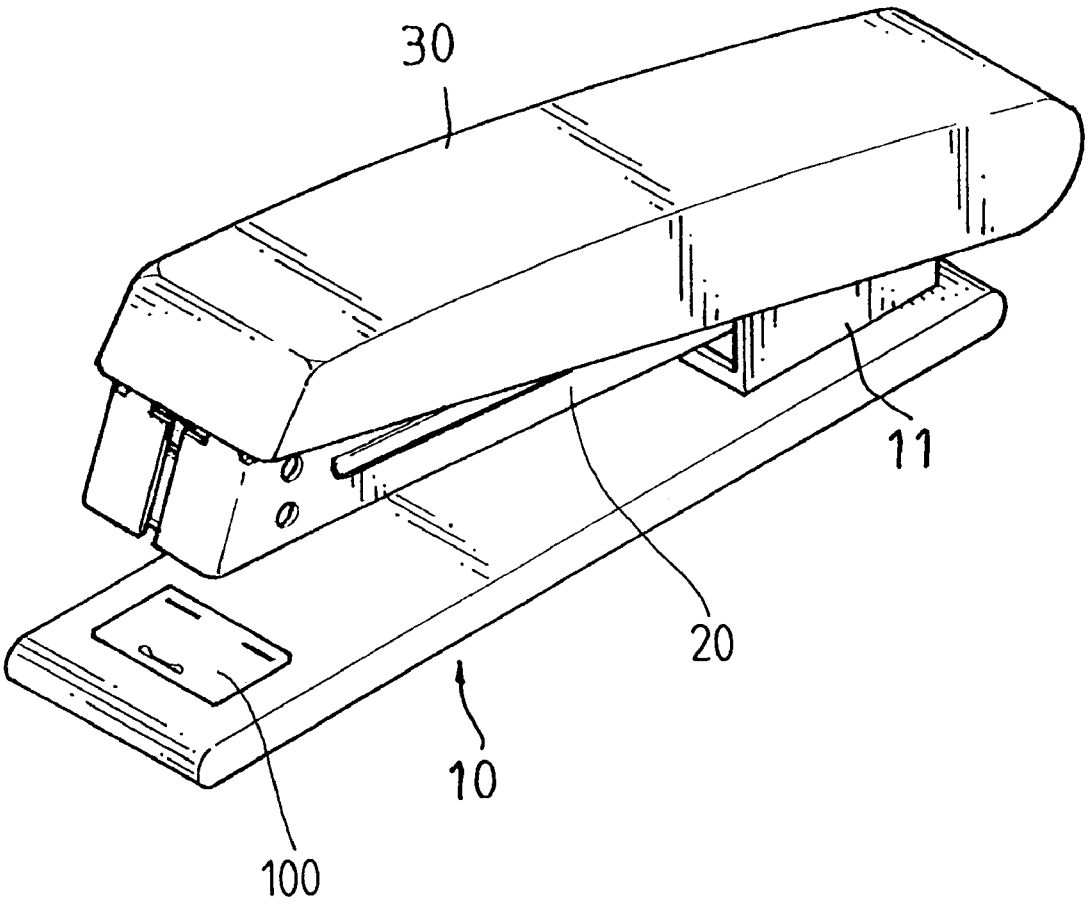
FIG. 1 is a perspective view of the stapler in accordance with the present invention.
Figure 2:
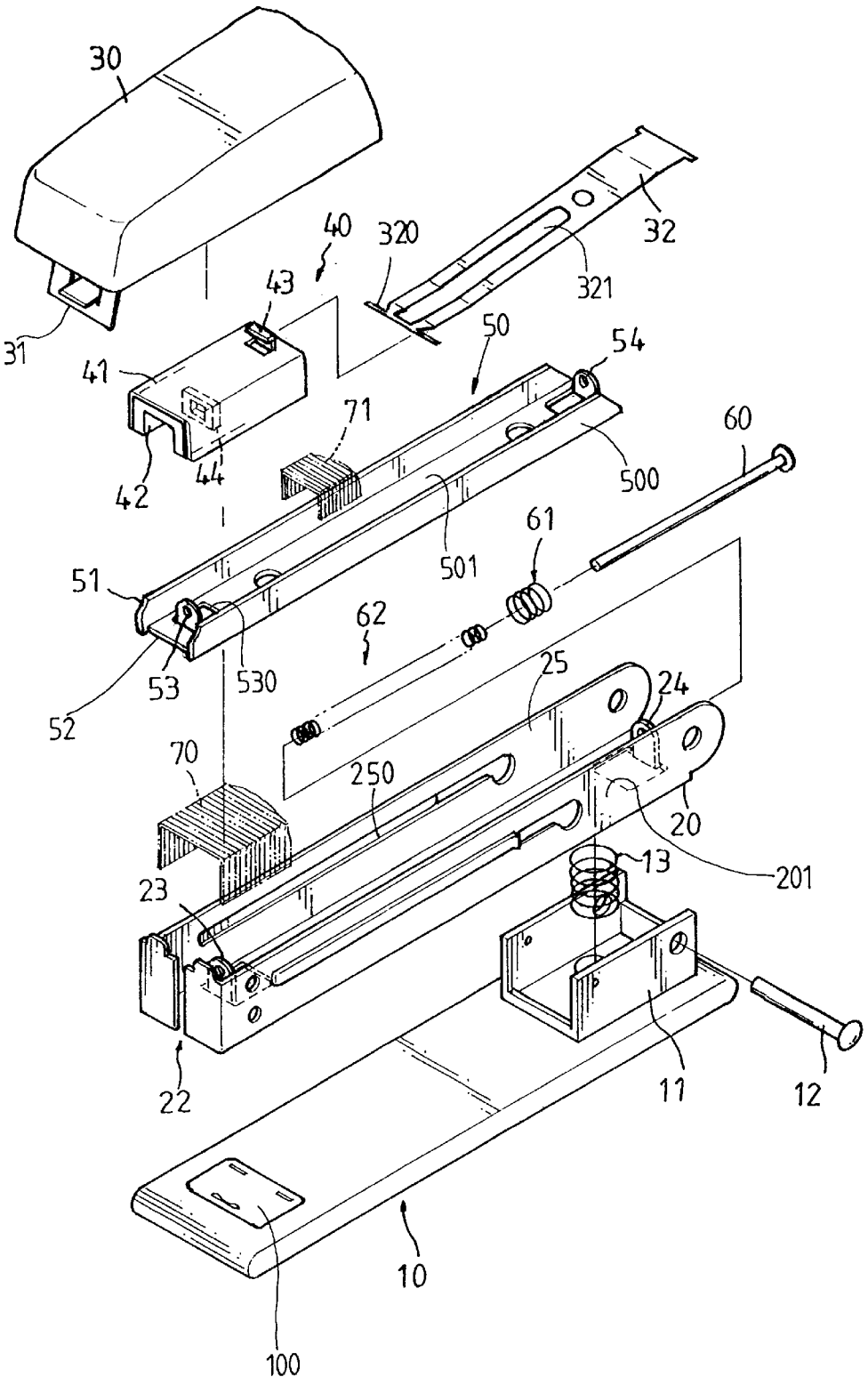
FIG. 2 is an exploded view of the stapler in accordance with the present invention.
Figure 3:
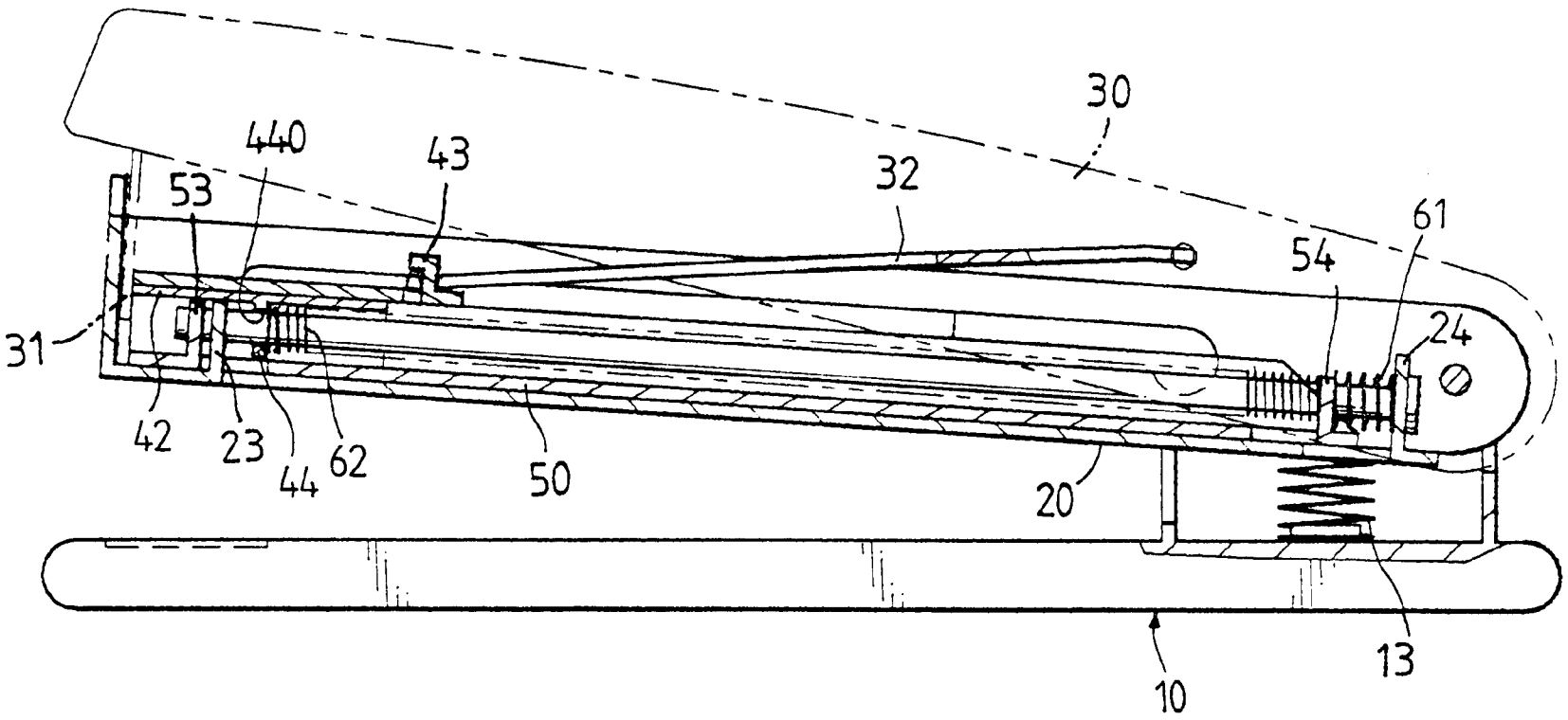
FIG. 3 is a side elevational view, partly in section, of the stapler in accordance with the present invention.
Figure 4:
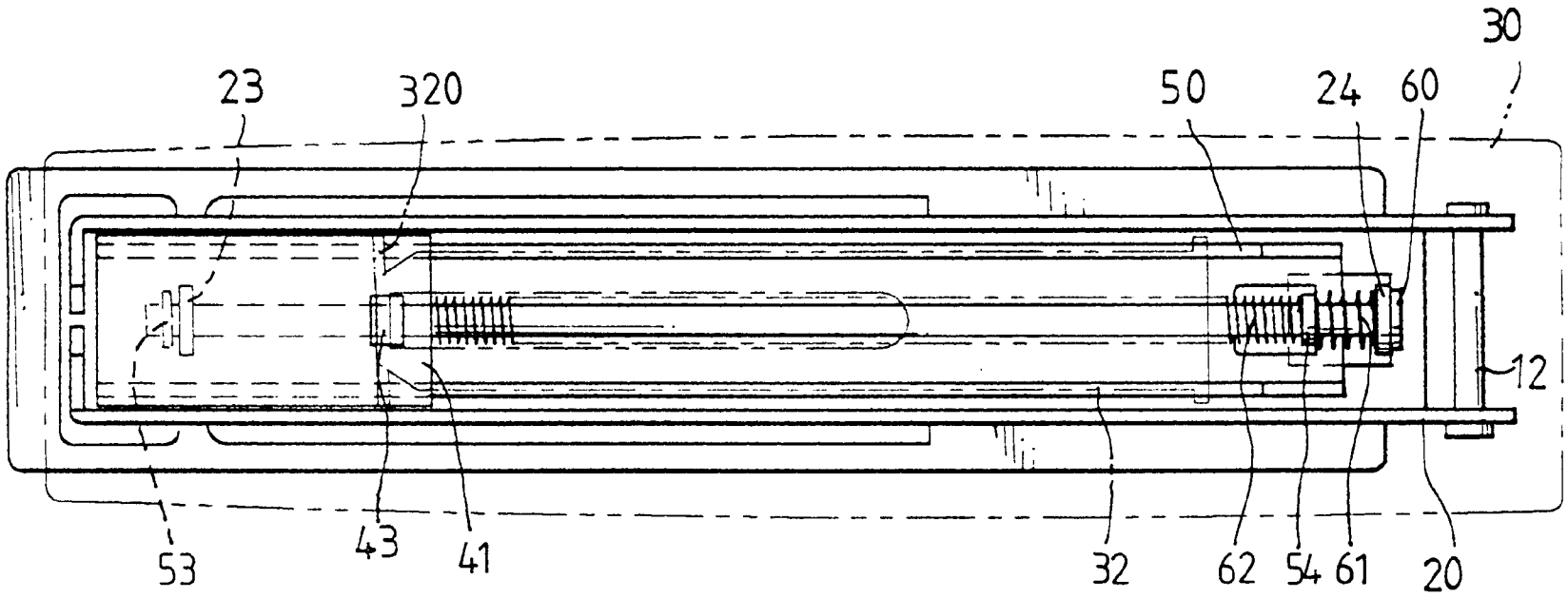
FIG. 4 is a top view, partly in section, of the stapler in accordance with the present invention.
Figure 5:
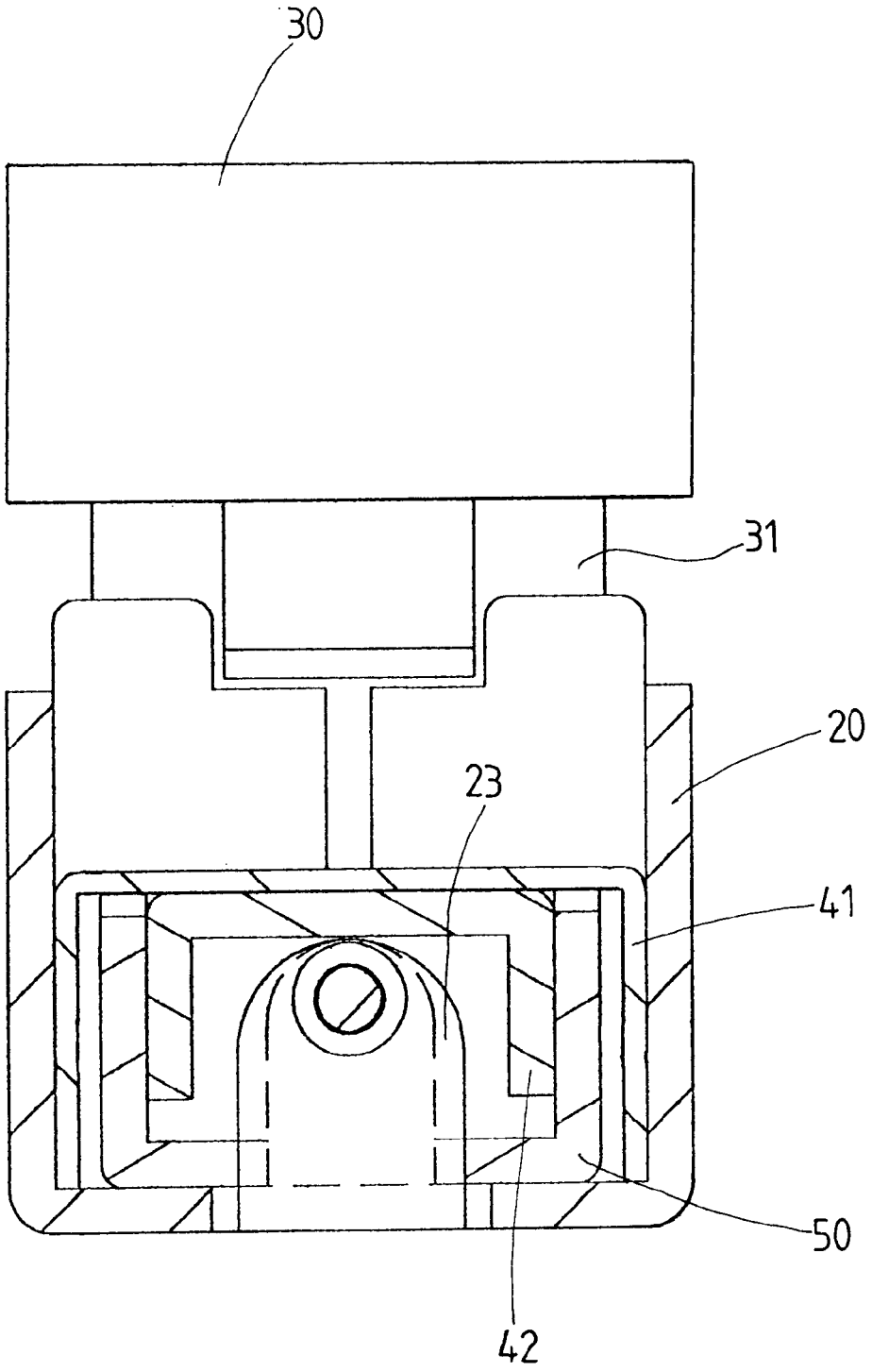
FIG. 5 is an end view, partly in section, of the stapler in accordance with the present invention.

Referring to FIGS. 1 through 4, a stapler comprises base 10 having a frame 11 extending from a first end thereof and an anvil 100 mounted to a second end thereof. An operation arm 30 has a first end thereof pivotally connected to the frame 11 and an ejecting plate 31 extending from a second end thereof. A first magazine 20 to has a first end thereof pivotally connected to the frame 11 by a pin 12 and a second end thereof having a slit 22 defined in a first bottom 201 thereof. Two first side walls 25 respectively extend from two sides of the first bottom 201 of the first magazine 20 and each of the two first side walls 25 has a groove 250 defined therethrough. A first lug 24 and a second lug 23 respectively extend from the first bottom 201 of the first end and the second end of the first magazine 20. A spring 13 is biased between the frame 11 and the first magazine 20.

A second magazine 50 is received in the first magazine 20 and has a second bottom 501 with two second side walls 500 extending from two sides of the second bottom 501. Each of the two second side walls 500 has an arcuated edge 51 defined in an end located above the slit 22 of the first magazine 20. A cutout 52 is defined in the second bottom 501 and located in alignment with the slit 22. A third lug 54 and a fourth lug 53 respectively extend from the second bottom 501 of the first end and the second end of the second magazine 50.

A staple follower 40 has an inner portion 42 slidably received between the two second side walls 500 and an outer portion 41 slidably received between the first side walls 25 and the second side walls 500. A fifth lug 44 extends from the inner portion 42 and a hook 43 formed to a top of the outer portion 41.

A flexible plate 32 has a first end thereof fixedly connected to the operation arm 30 and a second end from which two protrusions 320 respectively extend laterally therefrom so as to be movably retained in the two grooves 250 of the first magazine 20. The slot 321 is engaged with the hook 43 of the staple follower 40.

A rod 60 extends through the first lug 24, the third lug 54, the fifth lug 44, the second lug 23 and the fourth lug 53. A first spring 61 is mounted to the rod 60 and biased between the first lug 24 and the third lug 54 so as to push the second magazine toward the ejecting plate 31. A second spring 62 is mounted to the rod 60 and biased between the third lug 54 and the fifth lug 44 so as to push the staple follower 40 toward the ejecting plate 31.

It is to be noted that the second bottom 501 of the second magazine 50 has an aperture 530 defined through so that the second lug 23 of the first magazine 20 extends through the aperture 530 such that the second magazine 50 will not be separated from the first magazine 20 in the longitudinal direction.

When in use, the staples 71 with small size can be received in the second magazine 50 so that when pushing the operation arm 30 toward the staples 71, the first one of the staples 71 will be ejected by the ejecting plate 31 via the cutout 52 and the slit 22. When the staples 70 with large size are to be used, the staples 71 are removed from the second magazine 50 and the staples 70 are mounted between the second side walls 500 and the first side walls 25 so that the first one of the staples 70 will be ejected by the ejecting plate 31 via the slit 22. In the meanwhile, the second magazine 50 is pushed toward the frame 11 when the ejecting plate 31 contacts the two arcuated edges 51 of the second magazine 50. Accordingly, the stapler of the present invention can employ two different sized staples.

Although the invention has been explained in relation to its preferred embodiment, it is to be understood that many other possible modifications and variations can be made without departing from the spirit and scope of the invention as hereinafter claimed.

What is claimed is:

1. A stapler comprising:

a base having a frame extending from a first end thereof and an anvil mounted to a second end thereof;

an operation arm having a first end thereof pivotally connected to said frame and an ejecting plate extending from a second end thereof;

a first magazine having a first end thereof pivotally connected to said frame and a second end thereof having a slit defined in a first bottom thereof, two first side walls respectively extending from two sides of said first bottom of said first magazine, a first lug and a second lug respectively extending from said first bottom of said first end and said second end of said first magazine;

a second magazine received in said first magazine and having a second bottom with two second side walls extending from two sides of said second bottom, a cutout defined in said second bottom and located in alignment with said slit, a third lug and a fourth lug respectively extending from said second bottom of said first end and said second end of said second magazine;

a staple follower having an inner portion slidably received between said two second side walls and an outer portion slidably received between said first side walls and said second side walls, a fifth lug extending from said inner portion;

a flexible plate having a first end thereof fixedly connected to said operation arm and a second end thereof connected to said staple follower, and a rod extending through said first lug, said third lug, said fifth lug, said second lug and said fourth lug, a first spring mounted on said rod and biased between said first lug and said third lug, a second spring mounted on said rod and biased between said third lug and said fifth lug.

2. The stapler as claimed in claim 1, wherein each of said two second side walls has an arcuated edge defined in an end located above said slit of said first magazine.

3. The stapler as claimed in claim 1 further comprising an aperture defined through said second bottom of said second magazine and said second lug of said first magazine extending through said aperture.

4. The stapler as claimed in claim 1 further comprising a spring biased between said frame and said first magazine.

5. The stapler as claimed in claim 1, wherein said flexible plate has a slot defined therethrough and said staple follower has a hook formed to a top thereof so as to engage with said slot.

6. The stapler as claimed in claim 1, wherein said two first side walls each have a groove defined therethrough and said flexible plate has two protrusions respectively extending laterally therefrom so as to be movably retained in said two grooves.

* * * * *